US006685398B1

(12) United States Patent
Gunther

(10) Patent No.: US 6,685,398 B1
(45) Date of Patent: Feb. 3, 2004

(54) METHOD TO FORM IN-SITU PILINGS WITH DIAMETERS THAT CAN DIFFER FROM AXIAL STATION TO AXIAL STATION

(76) Inventor: Johan M. Gunther, 420 Georgina Ave., Santa Monica, CA (US) 90402

( * ) Notice: Subject to any disclaimer, the term of this patent is extended or adjusted under 35 U.S.C. 154(b) by 0 days.

(21) Appl. No.: 10/274,515

(22) Filed: Oct. 18, 2002

(51) Int. Cl.[7] ..... E02D 5/44; E02D 3/12

(52) U.S. Cl. ..... 405/237; 405/233; 405/263; 405/269

(58) Field of Search ..... 405/231, 232, 405/233, 237, 238, 236, 263, 267, 269; 175/57, 65, 71, 263, 265, 267, 284, 285, 288, 292

(56) References Cited

U.S. PATENT DOCUMENTS

| | | | | | |
|---|---|---|---|---|---|
| 1,970,063 | A | * | 8/1934 | Steinman | 175/285 |
| 3,802,203 | A | | 4/1974 | Ichise et al. | |
| 3,935,912 | A | * | 2/1976 | Shibata | 175/264 |
| 4,015,433 | A | * | 4/1977 | Shibata | 405/259.5 |
| 4,158,518 | A | * | 6/1979 | Rusche | 405/233 |
| 4,189,184 | A | * | 2/1980 | Green | 175/285 |
| 4,494,616 | A | * | 1/1985 | McKee | 175/67 |
| 4,585,678 | A | * | 4/1986 | Kunito | 405/267 |
| 4,606,675 | A | | 8/1986 | Mitani et al. | |
| 4,688,648 | A | * | 8/1987 | Ikeda et al. | 175/242 |
| 4,843,785 | A | * | 7/1989 | Sero et al. | 405/237 |
| 5,967,700 | A | | 10/1999 | Gunther | |
| 6,048,137 | A | * | 4/2000 | Beck, III | 405/233 |
| 6,070,677 | A | * | 6/2000 | Johnston, Jr. | 175/57 |
| 6,591,922 | B1 | * | 7/2003 | Rial et al. | 175/288 |
| 6,595,302 | B1 | * | 7/2003 | Diamond et al. | 175/65 |

FOREIGN PATENT DOCUMENTS

| | | | | |
|---|---|---|---|---|
| GB | 2128233 | * | 4/1984 | 405/267 |

OTHER PUBLICATIONS

Con–Tech Systems Ltd, Why Leading Contractors Choose CTS/Titan–IBO.

Micro–Piles—Advertisement, undated, Publisher unknown—Where published unknown.

* cited by examiner

*Primary Examiner*—Jong-Suk (James) Lee
(74) *Attorney, Agent, or Firm*—Donald D. Mon

(57) ABSTRACT

A process to make in-situ pilings comprised of soil, cement, lime and water, the pilings being bodies of revolution formed by rotating a mixer-cutter blade whose cutting diameter is selectably adjustable, preferably on a running basis so as to have the capability of producing piling with a diameter that differs from station to station.

9 Claims, 1 Drawing Sheet

METHOD TO FORM IN-SITU PILINGS WITH DIAMETERS THAT CAN DIFFER FROM AXIAL STATION TO AXIAL STATION

FIELD OF THE INVENTION

Pilings which are formed from parent soil combined with a dry binder such as lime or cement. The diameter of the resulting piling can be varied from station to station to fulfill local structural requirements.

BACKGROUND OF THE INVENTION

Stabilization of soil, and providing in-situ pilings with various physical properties that differ from their surroundings are known. The general technique is to bore into the soil, and while there, inject lime or cement, and sometimes water. The procedure mixes these materials together, and when they harden, they form a piling. The term"piling" is used to denote a vertical rigid cylindrical structure, a body of revolution, having a strong vertical compressive strength, and often a lesser permeability compared to surrounding structure such as a clay soil.

These pilings have a longitudinal vertical axis, and a peripheral side wall that extends from the surface of the soil to the bottom of the piling. For convenience, its locations along the axis will be referred to as"stations", with station zero at the surface.

The formation of such pilings is known, for example in Ichise et al U.S. Pat. No. 3,802,203 and Mitani et al U.S. Pat. No. 4,606,675 the injection of cement into a surrounding formation while an augur is pressed into the earth is shown. These systems rely on the presence of existing water, and cement or lime is added to make an appropriate mixture that will harden to form the piling.

Applicant's Gunther U.S. Pat. No. 5,967,700 performs the same function, but builds a piling constituted of a hardened stoichiometric mixture of the reactive ingredients. In particular this means adding the appropriate amount of water for the cement or lime from station to station.

In most of Europe, for example, usually there is enough water present to make at least a marginally effective piling. However this is not always the situation. For example in some areas around dams the soil is so dry that pits must be dug and water confined in them to soak the soil to the extent that a piling can ultimately be made, often many days later. The problem of dryness and variability of water content was solved by the said Gunther patent.

The established art enables cylindrical in-situ pilings to be formed to various degrees of certainty as to their properties. Especially the process defined in the Gunther patent can provide assurance that a stoichiometric mixture of water, lime and/or cement will be provided to assure the ultimate structural properties of the piling.

There remains, however, the limitation on all of the known processes that only a cylindrical piling is formed. This is not surprising, because the art of pilings has evolved from the driving of poles into the ground by percussive or vibration forces, or by drilling holes and later filling them with a material such as concrete, or as described above, mixing additives into a cylindrical structure to form an in-situ piling.

What is assumed in the established art is that a piling, even an in-situ piling that includes native soil in its composition will necessarily be consistent from top to bottom (which is the situation only with the said Gunther patent), and that its structural requirements will be the same from top to bottom.

To give assurance that the cylindrical shape will be adequate requires it to be over-designed for its location. This is because local conditions may vary from station to station. For example, an enlarged bulk might be needed near or at the lower end to anchor the piling in place or to take advantage of a very hard striation. To provident such a capacity there, the entire piling would have to be made as large.

Another example is the need for greater rigidity at some station where the surrounding earth is more fluid, or when an anchoring flange could usefully be formed to take advantage of a surrounding region of greater strength.

It is an object of this invention to provide a method to form a in-situ piling with a diameter which can selectively differ from station to station in a running manner so as to form a body of revolution with a structure suited to the requirement of localized regions in which it is generated.

BRIEF DESCRIPTION OF THE INVENTION

This invention can utilize many types of apparatus to accomplish its objectives. The necessary requirements are apparatus such as a rotary augur or drill which will be rotated around its axis while it is being driven into the ground and withdrawn from it. Its function is to enable its own progress into the ground and to mix or stir the loosened soil as it goes in and out.

According to this invention, the device develops a column with a selectible diameter to create an in-situ piling of optimum cross-section, and even to form pilings of different diameters from station to station, using the same apparatus.

According to a preferred but optional feature of the invention, the apparatus can provide water in an amount to supplement the existing water so that their total volume is stoichiometrically related to the amount needed for the strength of the piling of cement, lime, or other dry binder that acts with water to develop a hard body. Dry binders composed of synthetic materials are known and are included in this invention. By "dry" is meant their condition when injected into the soil, where upon they meet the water to solidify the piling.

The above and other features of this invention will be fully understood from the following detailed description and the accompanying drawings, in which:

DETAILED DESCRIPTION OF THE INVENTION

Apparatus will be employed to augur into the earth, and while doing so mix lime or cement into the earth it engages, and optionally may also add water in an amount to supplement existing water for a stoichiometric between the amount of cement or lime needed for strength of the piling. The details of such apparatus are of no particular importance to this invention, and are shown only schematically herein for purposes of illustration of the process.

Gunther U.S. Pat. No. 5,967,700 is hereby referred to and is incorporated herein by reference in its entirely for its showing of a system that does augur in and mix lime/cement and water as appropriate. It lacks provision for adjustably and selectively varying the diameter (and the outer configuration) of the piling, which it is the object of this invention to utilize.

Figure 1:
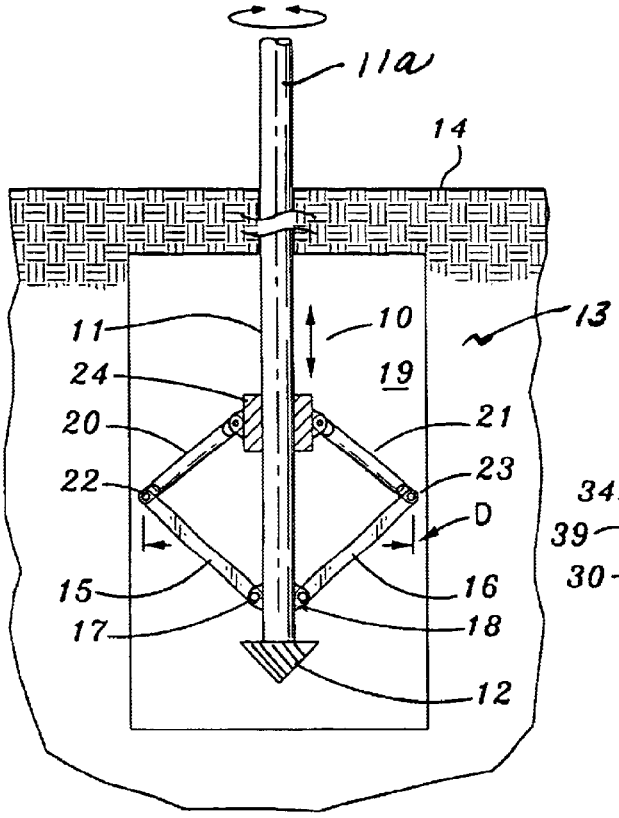
FIG. 1 is a schematic illustration of apparatus useful for the process of this invention.

FIG. 1 illustrates the scheme of apparatus 10 useful for this process. A central rotatable shaft 11 with a central axis 11*a* has a cutting bit 12 on its lower end adapted to make the leading entry into a body 13 of soil from its surface 14. The bit may be a rotary sharp edged plate or a fluted cone as preferred.

A pair of blades 15, 16 are pivoted to the shaft at hinges 17, 18, so they will be rotated around the central axis of the tool. At least theoretically, only one blade could be used, but the desirability of a balanced pair of blades is obvious.

A pair of adjustment rods 20, 21 are pivoted to respective blades 15, 16 by hinges 22, 23. At their other end they are pivoted to an adjustment sleeve 24 which is axially movable along the shaft, under control of some device which can move it, preferably located at the surface.

It will be observed that the distance D between the ends of the blades will be diameter of the piling 19 at that station (twice the radius of one tip). It is the purpose of this invention adjustably to select the value of diameter D.

The blades are provided to drill into the soil on the way down, and to mix the soil, water and cement on the way up. The blades are rotated while moving both up and down, as shown in the Gunther patent. Also, depending on the conditions, water may be injected through ports from the shaft (not shown), and powdered dry binder, of which cement and lime are examples, also from ports in the shaft (not shown).

Figure 2:
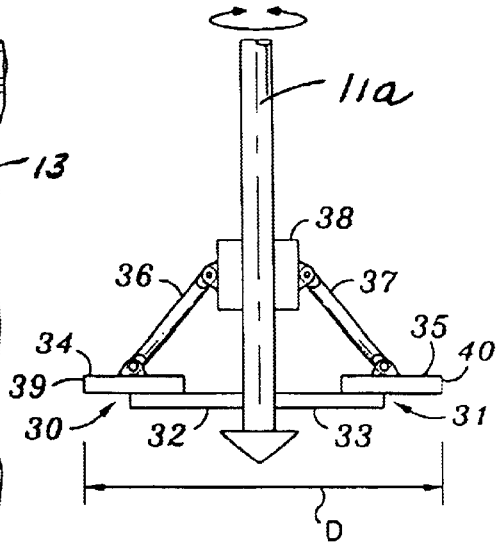
FIG. 2 is a schematic illustration of another suitable apparatus.

The specific construction of the apparatus is of no importance to the instant invention. For example, FIG. 2 shows the use of multiple piece, horizontal mixer-cutter blades 30, 31, each having a base blade 32, 33, and a secondary blade 34, 35. Both blades cut and mix. The secondary blades can be moved radially in and out by rods 36, 37 pivoted to a sleeve 38, so the diameter D of the bore will be that of the distance between the tips 39, 40 of the secondary blades, as established by movement of the sleeve. There are many other conceivable mechanisms for this purpose, the two examples being merely exemplary.

Regardless of the mechanism used, the resulting piling will be a solid surface of revolution with an outer boundary, whose outer wall diameter will be established by the dimension D between the tips of the blades. This invention contemplates using the same apparatus to form cylindrical pilings of different diameters from one piling to another. However, its principal advantages are in the process of providing a piling with different diameters from station to station in the same piling.

Frequently a piling will pass through regions of various hardness and wetness at different stations. In some of these, it may be desirable to have a larger diameter, perhaps to form an enlarged footing, or perhaps a collar to rest on harder soil, or perhaps to interface in a key-like manner with an adjacent piling.

Figure 3:
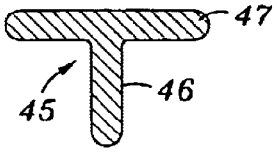
FIGS. 3–7 are schematic elevations of pilings which are made with this invention.

For example, FIG. 3 shows a piling 45 with a cylindrical shaft 46 depending from an enlarged head 47. This structure will give additional support for the piling from above.

Figure 4:
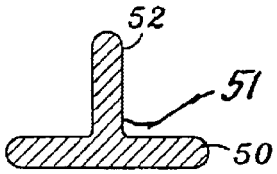

FIG. 4 shows the reverse, an enlarged footing 50 on a piling 51 supporting a rising shaft 52. This structure will provide a strong upward support and stabilizer for the piling.

Figure 5:
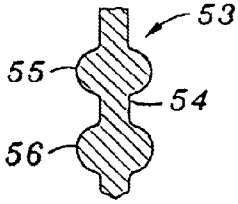

FIG. 5 shows a piling 53 with an undulating silhouette 54. The enlargements 55, 56 are spaced apart. For example they might "key" to a hard soil layer, or merely add resistance to vertical displacement of the piling.

Figure 6:
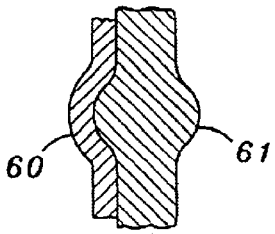

FIG. 6 illustrates a keying relatively between two pilings 60, 61 with undulating silhouettes that engage one another. This provides for mutual support of the pilings.

Figure 7:
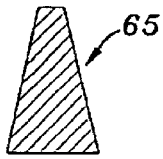

FIG. 7 illustrates a piling 65 with a continuously changing diameter. It is shown as a conical structure with an enlarged lower end. In practice the enlarged end could instead be the upper end. This illustrates the wide range of diameters and silhouettes that can be attained with this invention.

Accordingly, the process of this invention comprises forming in-situ pilings of selected diameter or diameters which may be different from piling to piling, or which may be varied from station to station along the length of the piling. As the blades move through the soil, a dry binder, examples of which are cement and lime, and sometimes water will be added so as to be mixed with the soil and form the piling when cured.

The preferred embodiment of the invention provides water to establish a wetness appropriate to a stoichiometric reaction with a dry binder such as cement or lime which is later mixed in with the appropriately wetted soil, as described in the Gunther patent.

This invention is not to be limited by the embodiments shown in the drawings and described in the description, which are given by way of example and not of limitation, but only in accordance with the scope of the appended claims.

What is claimed is:

1. A process for forming an in-situ piling which extends from and an intended top which is located at or near the surface of the soil to a depth, said piling having a central axis and a peripheral axially extending boundary extending from said intended top to its intended bottom, said piling comprising existing soil, existing water, and added dry binder, said process comprising:

utilizing a driven rotary shaft having a central axis of rotation, driving a mixer-cutter blade adapted to cut into and stir said soil, said blade being adjustably attached to said shaft whereby to extend laterally from said shaft by an adjustable distance, thereby to cut a circular area equal to twice its adjusted distance, rotating said shaft and turning said blade into said soil, thereby to form a circular bore of loosened soil whose boundary is surrounding soil that is not cut by the blade;

selecting and establishing along the axis of the bore at least two different said adjustable distances at axially spaced apart stations along said bore between the intended top and bottom of said piling, whereby to provide said boundary and thereby said piling with a plurality of axially spaced apart diameters;

while continuing to rotate the shaft, removing said blades from said bore;

at some time at every station between said intended top and bottom of said piling, injecting said dry binder into the bore and stirring of the mixture of said soil, dry binder and existing water; and permitting said mixture to cure to a hardened body of revolution comprising said in-situ pilings.

2. A process according to claim 1 in which said adjustment creates a piling with a local enlargement.

3. A process according to claim 2 in which the enlargement is at the intended top or at the intended bottom of the piling.

4. A process according to claim 2 in which there is provided a plurality of said enlargements axially spaced apart from one another.

5. The process of claim 1 in which additional water is added to existing water in the soil in an amount to provide a stoichiometric reaction with the dry binder which is added to the soil in this process.

6. A process according to claim 5 in which said adjustment creates a piling with a local enlargement.

7. A process according to claim 6 in which the enlargement is at the intended top or at the intended bottom of the piling.

8. A process according to claim 6 in which there is provided a plurality of said enlargements axially spaced apart from one another.

9. A process according to claim 1 in which the dry binder comprises dry lime or dry cement or their mixture.

* * * * *